United States Patent [19]

Michael

[11] 4,164,049

[45] Aug. 14, 1979

[54] VACUUM-TYPE WATER REMOVAL SYSTEM FOR HOUSES, FACTORIES, SHIPS AND THE LIKE

[75] Inventor: Harald R. Michael, Hamburg, Fed. Rep. of Germany

[73] Assignee: Electrolux GmbH, Fed. Rep. of Germany

[21] Appl. No.: 855,672

[22] Filed: Nov. 29, 1977

[30] Foreign Application Priority Data

Dec. 1, 1976 [DE] Fed. Rep. of Germany ..... 2654437

[51] Int. Cl.[2] ..... E03D 5/00

[52] U.S. Cl. ..... 4/300; 4/198; 4/431; 137/205; 137/236 R

[58] Field of Search ..... 137/205, 236; 4/300, 4/424, 431, 421, 198, 206, 1, 434

[56] References Cited

U.S. PATENT DOCUMENTS

| | | | |
|---|---|---|---|
| 3,302,216 | 2/1967 | Fulton | 4/434 |
| 3,686,693 | 8/1972 | Liljendahl | 137/205 |
| 3,746,032 | 7/1973 | Wallgren | 137/205 |

*Primary Examiner*—Alan Cohan

*Attorney, Agent, or Firm*—Larson, Taylor & Hinds

[57] ABSTRACT

A vacuum-type water removal system for buildings, factories, ships and the like is provided wherein waste water collection devices, such as sanitary facilities (e.g., toilets) and other waste producing/or collecting devices, are connected through a cut-off valve to a vacuum conduit for removal of the waste water. The invention concerns the provision of a supplemental arrangement including an overflow opening for the collection devices which is connected to a gravity feed line that feeds a collection chamber connected through a check valve to the vacuum line.

4 Claims, 2 Drawing Figures

VACUUM-TYPE WATER REMOVAL SYSTEM FOR HOUSES, FACTORIES, SHIPS AND THE LIKE

FIELD OF THE INVENTION

The invention relates to a vacuum-type water removal system for houses, factories, ships or the like, wherein sanitary facilities, receptacles, machines and the like which collect and/or produce waste water are individually connected through a cut-off valve directly to a vacuum waste water conduit.

BACKGROUND OF THE INVENTION

A water removal system of the type referred to above and adapted for use with vacuum toilets having a manually operated cut-off valve, is described, for example, in German Pat. No. 1,302,597. In other known facilities wherein waste water is collected, an automatic check valve can be used, i.e., a valve whose operation is controlled as a function of the system water level or as a function of time.

In other conventional systems, waste water from several different facilities is first allowed to flow through gravity feed lines into a collector receptacle which is connected to a vacuum waste water removal conduit through a cut-off valve, the cut-off valve being controlled as a function of the level of the water in the receptacle and being emptied when a specific level is reached. An example of such a system is disclosed in German Patent No. OS 2,455,551.

The two different types of vacuum water removal systems mentioned above are always installed individually. In some cases the systems are employed in addition to conventional water removal systems including gravity feed lines, but in parallel therewith to, and always independently of each other. Therefore, any efforts made hereintofore to solve technical difficulties and problems have been concentrated on special measures taken with respect to the individual systems themselves.

There is a special problem in waste water facilities such as toilets, water collectors and the like which are directly connected via a cut-off valve to a vacuum waste water removal conduit. Specifically, in such systems the cut-off valve is designed to always remain in a tightly closed state, and to open only briefly during the emptying process. If, because of a detect in the water supply (e.g., a leaky faucet or water intake in a vacuum toilet), or in the control of the cut-off valve (e.g., because of a failure of the vacuum in the system, or due to clogging or seizing) and a resultant unintentional and unnoticed water flow when the cut-off valve is closed, a serious overflow problem can result. This problem of possible overflow has been known as long as vacuum toilets have been in existence.

An attempt has been made to eliminate the problem through the use of automatic controls for the cut-off valve which automatically open the valve when the associated facility reaches a specific filling level and which close the valve again after emptying. Automatic controls providing such safety precautions are relatively complicated and expensive. In addition, such controls are subject to failure.

SUMMARY OF THE INVENTION

The present invention concerns the problem of providing a water removal system of the type in question wherein reliable safeguards against overflow and flooding are provided in a relatively simple manner.

Generally speaking, according to the invention, the waste water collecting devices, i.e., sanitary facilities, receptacles or the like, are supplementarily connected through an overflow opening associated therewith to a gravity feed line that feeds a collector receptacle connected through a cut-off valve to the vacuum waste water conduit. In this way, overflow or flooding of the water of the sanitary facilities is simply and reliably prevented.

Since the collector receptacle generally can be installed at a location (e.g., out of doors) where flooding will cause no damage and not be noticed, and since the collector receptacle can also be sufficiently large to accommodate overflow, the danger of flooding such as might occur, for example, during an extended absence, is substantially eliminated. Further, the collector receptacle can be connected to a backwash receptacle to provice an increased capacity and thus provide additional protection from overflow caused by a system malfunction.

Advantageously, other sanitary facilities are connected only to the gravity feed line that feeds the collector receptacle, in addition to those which are connected directly to the vacuum waste water conduit.

The collector receptacle can be connected in a conventional manner to a vacuum conduit system other than that of vacuum toilets, these toilets having direct vacuum conduit connections. In such an arrangement, increased flexibility is provided so that in handling this waste water, for example, fecal waste water can be separated from flushing and washing water. However, it is also possible by using suitable conduit cross sections and appropriate quantities of air to be sucked into the vacuum conduit with each emptying process, to connect the facility, e.g., a toilet, which is directly emptied, together with the collector receptacle for facilities (such as wash basins, washing machines, bath tubs etc.) that are emptied through gravity feed lines or conduits, to the same vacuum conduit system. In this way all sanitary facilities are ultimately connected directly or indirectly to the same vacuum waste water conduit.

According to another aspect of the invention, the sanitary facilities, receptacles or the like are supplementarily connected by means of an overflow opening to a gravity conduit connected to the ambient air.

Other features and advantages of the invention will be set forth in, or apparent from, the detailed description of the preferred embodiment found hereinbelow.

DESCRIPTION OF THE PREFERRED EMBODIMENTS

Figure 1:
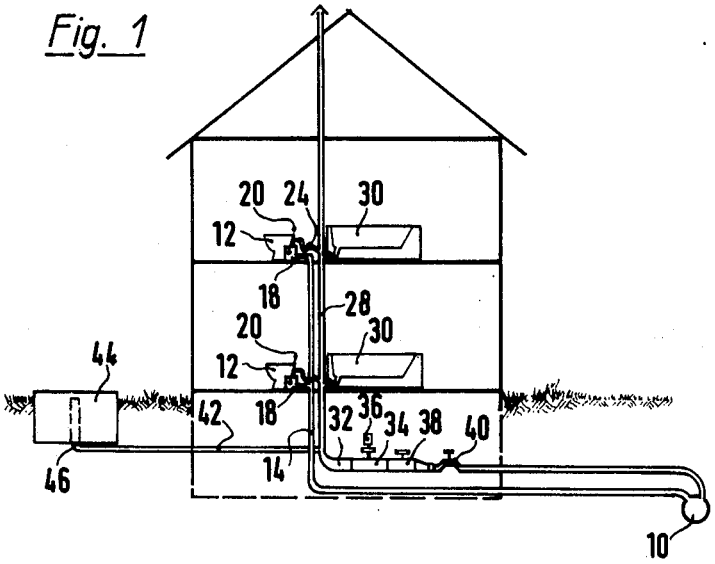
FIG. 1 shows a highly diagrammatic cross sectional view of a house in which is incorporated a water removal system in accordance with the invention.
Figure 2:
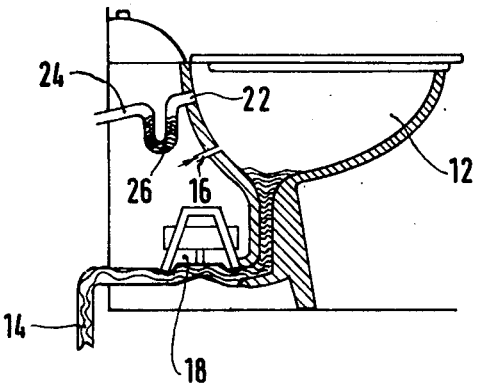
FIG. 2 shows a diagrammatic cross sectional view of a vacuum toilet designed to incorporate the water removal system of the invention.

A vacuum line or conduit 10 provided for removal of waste water from a house or building is shown schematically in FIG. 1, the waste water going for example to a clearing installation (not shown) by means of a vacuum station (not shown) as is conventional. Sanitary facilities, which are denoted 12 in the drawings and take the form of toilets, are connected, individually or through a common removal line or conduit 14, directly to vacuum conduit 10. Each toilet 12 has a water connection 16 (see FIG. 2) through which about one or two liters of water will flow under pressure into the toilet with each flushing. Each vacuum toilet 12 also has a cut-off valve 18 associated therewith which separates the toilet bowl from vacuum conduit 14. Each cut-off valve 18 is temporarily opened for emptying and flushing by means of an associated operating element indicated at 20. Cut-off valves of this type, and suitable control devices therefore are described, for example in German Pat. Nos. 1,302,597 and 1,709,090.

Because cut-off valves 18 are normally closed and also are not affected by the water level in the toilet bowl, the toilets 12 could run over, during vacation for instance, if the water connection 16 were leaky. To eliminate this risk, each vacuum toilet 12, in addition to the connection thereof to vacuum conduit 14, is supplied with an overflow opening 22 (see FIG. 2) which is connected by a connecting line or conduit 24 to a gravity flow line or feed conduit 28. Gravity feed conduit 28 is also connected to the bath tubs 30 in the dwelling and serves to empty the same. Connecting conduit 24 includes an U-shaped odor closure or trap 26, as illustrated.

The lower end of gravity conduit 28 is widened to form a collector receptacle or chamber 32, to which are connected a conduit section 34 having associated air control box 36, a servicing unit 38, and a cut-off valve 40, all of the latter being connected on the suction side to vacuum waste water conduit 10.

As illustrated, a conduit 42 can be provided at a location above collection chamber 32 which branches off to a watertight backwash receptacle or pit 44 located outside of the house. Pit 44 is preferably provided with a discharge opening 46, as illustrated.

In an alternate embodiment, conduits from two separate houses or the like which are connected to vacuum conduit 10 can be joined to form a single house connecting conduit inside the house upstream of cut-off valve 40.

Although the invention has been described relative to exemplary embodiments thereof, it will be understood that other variations and modifications can be effected in these embodiments without departing from the scope and spirit of the invention.

I claim:

1. In a vacuum-type water removal system for houses, factories, ships and the like, wherein waste water collection devices such as sanitary facilities and other waste water producing and/or collection devices, are individually connected through a cut-off valve to a vacuum waste water removal line, the improvement wherein said waste water collection devices include an overflow opening, and supplementary connecting means are provided for connecting the overflow opening to a gravity feed conduit which feeds a collection chamber connected through a cut-off valve to the vacuum waste water removal line.

2. A water removal system as claimed in claim 1 wherein further said waste water collection devices are connected solely to the gravity feed conduit which feeds said collection chamber.

3. A water removal system as claimed in claim 2 wherein all of the waste water collection devices are ultimately connected either directly or indirectly to the same said vacuum waste water removal line.

4. A water removal system as claimed in claim 3 wherein said collection device comprises a toilet and said overflow opening is provided in the toilet bowl at a predetermined level and is connected through an odor trap to a gravity feed conduit.

* * * * *